US007430506B2

(12) United States Patent
Nam et al.

(10) Patent No.: US 7,430,506 B2
(45) Date of Patent: Sep. 30, 2008

(54) PREPROCESSING OF DIGITAL AUDIO DATA FOR IMPROVING PERCEPTUAL SOUND QUALITY ON A MOBILE PHONE

(75) Inventors: Young Han Nam, Seoul (KR); Seop Hyeong Park, Seoul (KR); Yun Ho Jeon, Seoul (KR)

(73) Assignee: RealNetworks Asia Pacific Co., Ltd., Seoul (KR)

( * ) Notice: Subject to any disclaimer, the term of this patent is extended or adjusted under 35 U.S.C. 154(b) by 746 days.

(21) Appl. No.: 10/753,713

(22) Filed: Jan. 8, 2004

(65) Prior Publication Data

US 2005/0091040 A1 Apr. 28, 2005

(30) Foreign Application Priority Data

Jan. 9, 2003 (KR) ..... 10-2003-0001330

(51) Int. Cl.
*G10L 11/04* (2006.01)
*G10L 19/00* (2006.01)
*G10L 21/00* (2006.01)

(52) U.S. Cl. ..... 704/207; 704/500

(58) Field of Classification Search ..... 704/501, 704/207

See application file for complete search history.

(56) References Cited

U.S. PATENT DOCUMENTS 4,856,068 A * 8/1989 Quatieri et al. ..... 704/227
6,397,177 B1 5/2002 Isabelle
6,694,293 B2 * 2/2004 Benyassine et al. ..... 704/229
2002/0184005 A1 * 12/2002 Gigi ..... 704/201

FOREIGN PATENT DOCUMENTS

| | | |
|---|---|---|
| KR | 2002-0068585 | 8/2002 |
| WO | 96/05592 | 2/1996 |
| WO | 00/11654 | 3/2000 |
| WO | WO 01/03125 | 1/2001 |

(Continued)

OTHER PUBLICATIONS

Tuncer, 'Single Injection Wtih Perceptual Criteria', Elektrik, vol. 6, No. 2, 1998, pp. 89-106, http://journals.tubitak.gov.tr/elektrik/issues/elk-98-6-2/elk-6-2-3-97038.pdf.*

(Continued)

*Primary Examiner*—David R. Hudspeth
*Assistant Examiner*—Justin W Rider
(74) *Attorney, Agent, or Firm*—Schmeiser, Olsen & Watts LLP

(57) ABSTRACT

Since music signals are encoded by a voice encoding method optimized to human voice signals such as EVRC (Enhanced Variable Rate Coding) in a cellular communication system, the music signals are often distorted by such encoding method, and listeners experience pauses in music caused by such voice-optimized encoding method. To improve the perceptual sound quality of music, a method for preprocessing digital audio data is provided in order to prevent the problem of pause in music signals in a cellular phone. In particular, AGC (Automatic Gain Control) preprocessing and PHE (Pitch Harmonics Enhancement) is performed to the digital audio data having low dynamic range. By this method, the number of pauses in music signal is reduced, and the perceptual sound quality of the music is improved.

23 Claims, 12 Drawing Sheets

FOREIGN PATENT DOCUMENTS

WO WO 02/099787 12/2002

OTHER PUBLICATIONS

Ramalho, M.A.; Mammone R.J. "New speech enhancement techniques using the pitch mode modulation model" In: IEEE Circuits and Systems, 1993 Proceedings of the 36th Midwest Symposium on, Aug. 16-18, 1993, pp. 1531-1534 vol. 2.

Pollastri, E. "A pitch tracking system dedicated to process singing voice for musical retrival" In: IEEE Multimedia and Expo, 2002. ICME'02.Proceedings.2002 IEEE pp. 341-344 vol. 1.

* cited by examiner

PREPROCESSING OF DIGITAL AUDIO DATA FOR IMPROVING PERCEPTUAL SOUND QUALITY ON A MOBILE PHONE

FIELD OF THE INVENTION

The present invention is directed to a method for preprocessing digital audio data in order to improve the perceptual sound quality of the music decoded at receiving ends such as mobile phones; and more particularly, to a method for preprocessing digital audio data in order to mitigate degradation to music sound that can be caused when the digital audio data is encoded/decoded in a wireless communication system using codecs optimized for human voice signals.

BACKGROUND OF THE INVENTION

The channel bandwidth of a wireless communication system is much narrower than that of a conventional telephone communication system of 64 kbps, and thus digital audio data in a wireless communication system is compressed before being transmitted. Methods for compressing digital audio data in a wireless communication system include QCELP (QualComm Code Excited Linear Prediction) of IS-95, EVRC (Enhanced Variable Rate Coding), VSELP (Vector-Sum Excited Linear Prediction) of GSM (Global System for Mobile Communication), RPE-LTP (Regular-Pulse Excited LPC with a Long-Term Predictor), and ACELP (Algebraic Code Excited Linear Prediction). All of these listed methods are based on LPC (Linear Predictive Coding). Audio compressing methods based on LPC utilize a model optimized to human voices and thus are efficient to compress voice at a low or middle encoding rate. In a coding method used in a wireless system, to efficiently use the limited bandwidth and to decrease power consumption, digital audio data is compressed and transmitted only when speaker's voice is detected by using what is called the function of VAD (Voice Activity Detection).

There are various reasons why the perceptual sound quality of digital audio data is degraded after the digital audio data is compressed using audio codecs based on LPC, especially EVRC codecs. The perceptual sound quality degradation occurs in the following ways.

(i) Complete loss of frequency components in a high-frequency bandwidth (ii) Partial loss of frequency components in a low-frequency bandwidth (iii) Intermittent pause of music The first cause of the degradation cannot be avoided as long as the high-frequency components are removed using a 4 kHz (or 3.4 kHz) lowpass filter when digital audio data is compressed using narrow bandwidth audio codec.

The second phenomenon is due to the intrinsic characteristic of the audio compression method based on LPC. According to the LPC-based compression methods, a pitch and a formant frequency of an input signal are obtained, and then an excitation signal for minimizing the difference between the input signal and the composite signal calculated by the pitch and the formant frequency of the input signal, is derived from a codebook. It is difficult to extract a pitch from a polyphonic music signal, whereas it is easy in case of a human voice. In addition, the formant component of music is very different from that of a person's voice. Consequently, it is expected that the prediction residual signals for music data would be much larger than those of human speech signal, and thus many frequency components included in the original digital audio data are lost. The above two problems, that is, loss of high and low frequency components are due to inherent characteristic of audio codecs optimized to voice signals, and inevitable to a certain degree.

The pauses in digital audio data are caused by the variable encoding rate used by EVRC. An EVRC encoder processes the digital audio data with three rates (namely, 1, ½, and ⅛). Among these rates, ⅛ rate means that the EVRC encoder determines that the input signal is a noise, and not a voice signal. Because sound of a percussion instrument, such as a drum, include spectrum components that tend to be perceived as noises by audio codecs, music including this type of sound is frequently paused. Also, audio codecs consider sound having a low amplitude as noises, which also degrade the perceptual sound quality.

Recently, several services for providing music to wireless phone users became available. One of which is what is called "Coloring service" which enables a subscriber to designate a tune of his/her choice so that callers who make a call to the subscriber would hear music instead of the traditional ringing tone until the subscriber answers the phone. Since this service became very popular first in Korea where it originated and then in other countries, transmission of music data to a cellular phone has been increasing. However, as explained above, the audio compression method based on LPC is suitable for human voice that has limited frequency components. When music or signals having frequency components spread out through the audible frequency range (20-20,000 Hz) are processed in a conventional LPC based codecs and transmitted through a cellular system, signal distortion occurs, which causes pauses in music.

SUMMARY OF THE INVENTION

The present invention provides a method for preprocessing an audio signal to be transmitted via wireless system in order to improve the perceptual sound quality of the audio signal received at a receiving end. The present invention provides a method for mitigating the deterioration of perceptual sound quality occurring when music signal is processed by codes optimized for human voice, such as an EVRC codecs. Another object of the present invention is to provide a method and system for preprocessing digital audio data in a way that can be easily adopted in the conventional wireless communication system, without significant modification to the existing system. The present invention can be applied in a similar manner to other codecs optimized for human voice other than EVRC as well.

In order to achieve the above object, the present invention provides a method for preprocessing audio signal to be processed by a codec having a variable coding rate, comprising the step of performing a pitch harmonic enhancement ("PHE") preprocessing of the audio signal, to thereby enhance the pitch components of the audio signal.

The step of performing PHE preprocessing comprises the step of applying a smoothing filter in a frequency domain or performing Residual Peak Enhancement ("RPE").

The smoothing filter can be a Multi-Tone Notch Filter ("MTNF") for decreasing residual energy. MTNF can be applied by evaluating a Global Masking Threshold ("GMT") curve of the audio signal in accordance with a perceptual sound model; and selectively suppressing frequency components under said GMF curve.

BRIEF DESCRIPTION OF THE DRAWINGS

The above object and features of the present invention will become more apparent from the following description of the preferred embodiments given in conjunction with the accompanying drawings.

DETAILED DESCRIPTION OF THE INVENTION

As a way to solve the problem of intermittent pauses, the present invention provides a method of preprocessing digital audio data before it is subject to an audio codec. Certain type of sounds (such as one of a percussion instrument) include spectrum components that tend to be perceived as noises by audio codecs optimized for human voice (such as codes for wireless system), and audio codecs consider the portions of music having low amplitudes as noises. This phenomenon has been generally observed in all systems employing DTX (discontinuous transmission) based on VAD (Voice Activity Detection) such as GSM (Global System for Mobile communication). In case of EVRC, if data is determined as noise, that data is encoded with a rate of ⅛ among the three predetermined rates of ⅛, ½ and 1. If some portion of music data is decided as noise by the encoding system, the portion cannot be heard at the receiving end after the transmission, thus severely deteriorating the quality of sound.

This problem can be solved by preprocessing digital audio data so that the encoding rates of an EVRC codec may be decided as 1 (and not ⅛) for frames of music data. According to the present invention, the encoding rate of music signals can be increased through preprocessing, and therefore, the pauses of music perceived at the receiving end are reduced. Although the present invention is explained with regard to the EVRC codec, a person skilled in the art would be able to apply the present invention to other compression system using variable encoding rates, especially a codec optimized for human voice (such as an audio codec for wireless transmission).

Figure 1:
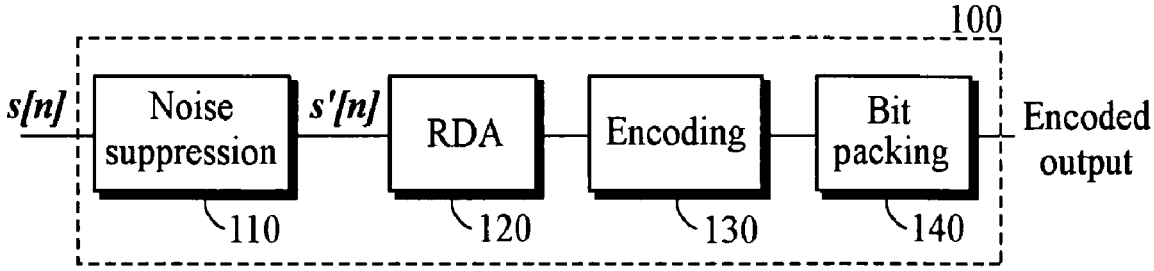
FIG. 1 is a block diagram of an EVRC encoder.

With reference to FIG. 1, RDA (Rate Decision Algorithm) of EVRC will be explained. EVRC will be explained as an example of a compression system using a variable encoding rate for compressing data to be transmitted via a wireless network where the present invention can be applied. Understanding of the rate decision algorithm of the conventional codec used in an existing system is necessary, because the present invention is based on an idea that, in a conventional codec, some music data may be encoded at a data rate that is too low for music data (though the rate maybe adequate for voice data), and by increasing the data rate for the music data, the quality of the music after the encoding, transmission and decoding can be improved.

FIG. 1 is a high-level block diagram of an EVRC encoder. In FIG. 1, an input may be an 8 k, 16 bit PCM (Pulse Code Modulation) audio signal, and an encoded output may be digital data whose size can be 171 bits per frame (when the encoding rate is 1), 80 bits per frame (when the encoding rate is ½), 16 bits per frame (when the encoding rate is ⅛), or 0 bit (blank) per frame depending on the encoding rate decided by the RDA. The 8 k, 16 bit PCM audio signal is coupled to the EVRC encoder in units of frames where each frame has 160 samples (corresponding to 20 ms). The input signal s[n] (i.e., an $n_{th}$ input frame signal) is coupled to a noise suppression block 110, which checks whether the input frame signal s[n] is noise or not. In case the input frame signal is considered as noise by the noise suppression block 160, it multiplies a gain of less than 1 to the signal, thereby suppressing the input frame signal. And then, s'[n] (i.e., a signal which has passed through the block 110) is coupled to an RDA block 120, which selects one rate from a predefined set of encoding rates (1, ½, ⅛, and blank in the embodiment explained here). An encoding block 130 extracts proper parameters from the signal according to the encoding rate selected by the RDA block 120, and a bit packing block 140 packs the extracted parameters to conform to a predetermined output format.

As shown in the following table, the encoded output can have 171, 80, 16 or 0 bits per frame depending on the encoding rate selected by RDA.

TABLE 1

| Frame type | Bits per frame |
|---|---|
| Frame with encoding rate 1 | 171 |
| Frame with encoding rate ½ | 80 |
| Frame with encoding rate ⅛ | 16 |
| Blank | 0 |

The RDA block 120 divides s'[n] into two bandwidths (f(1) of 0.3~2.0 kHz and f(2) of 2.0-4.0 kHz) by using a bandpass filter, and selects the encoding rate for each bandwidth by comparing an energy value of each bandwidth with a rate decision threshold ("RDT") decided by BNE. The following equations are used to calculate the two thresholds for f(1) and f(2).

$$T_1=k_1(SNR_{f(i)}(m-1))B_{f(i)}(m-1) \quad \text{Eq. (1a)}$$

$$T_2=k_2(SNR_{f(i)}(m-1))B_{f(i)}(m-1) \quad \text{Eq. (1b)}$$

Wherein $k_1$ and $k_2$ are threshold scale factors, which are functions of SNR (Signal-to-Noise Ratio) and increase as SNR increases. Further, $B_{f(i)}(m-1)$ is BNE for f(i) band in the $(m-1)_{th}$ frame. As described in the above equations, the rate decision threshold (RDT) is decided by multiplying the scale coefficient and BNE, and thus, is proportional to BNE.

On the other hand, the band energy may be decided by $0_{th}$ to $16_{th}$ autocorrelation coefficients of digital audio data belonging to each frequency bandwidth.

$$BE_{f(i)} = R_w(0)\,R_{f(i)}(0) + 2.0\sum_{k=1}^{L_h-1} R_w(k)\,R_{f(i)}(k) \qquad \text{Eq. (2)}$$

Wherein $BE_{f(i)}$ is an energy value for $i_{th}$ frequency bandwidth (i=1, 2), $R_w(k)$ is a function of autocorrelation coefficients of an input digital audio signal, and $R_{f(i)}(k)$ is an autocorrelation coefficient of an impulse response in a bandpass filter. $L_h$ is a constant of 17.

Then, the update of an estimated noise ($B_{m,i}$) will be explained. The estimated noise ($B_{m,i}$) for $i_{th}$ frequency band (or f(i)) of $m_{th}$ frame is decided by the estimated noise ($B_{m-1,i}$) for f(i) of $(m-1)_{th}$ frame, smoothed band energy ($E^{SM}_{m,i}$) for f(i) of $m_{th}$ frame, and a signal-to-noise ratio ($SNR_{m-1,i}$) for f(i) of $(m-1)_{th}$ frame, which is represented in the pseudo code below.

```
if (β < 0.30 for 8 or more consecutive frames)
   B_m,i = min{E^sm_m,i, 80954304, max{1.03B_m−1,i, B_m−1,i + 1}}
else{
   if (SNR_m−1,i > 3)
      B_m,i = min{E^SM_m,i, 80954304, max{1.00547B_m−1,i, B_m−1,i+1}}
   else
      B_m,i = min{E^SM_m,i, 80954304, B_m−1,i}
   }
   if (B_m,i < lownoise(i))
   B_m,i = lownoise(i)
   m = m+1
}
```

As described above, if the value of β, a long-term prediction gain (how to decide β will be explained later) is less than 0.3 for more than 8 frames, the lowest value among (i) the smoothed band energy, (ii) 1.03 times of the BNE of the prior frame, and (iii) a predetermined maximum value of a BNE (80954304 in the above) is selected as the BNE. Otherwise (if the value of β is not less than 0.3 in any of the 8 consecutive frames), if SNR of the prior frame is larger than 3, the lowest value among (i) the smoothed band energy, (ii) 1.00547 multiplied by BNE of the prior frame, and (iii) a predetermined maximum value of a BNE is selected as the BNE for this frame. If SNR of the prior frame is not larger than 3, the lowest value among (i) the smoothed band energy, (ii) the BNE of the prior frame, and (iii) the predetermined maximum value of BNE is selected as the BNE for this frame. Further, if the value of the selected BNE is not larger than a predetermined minimum value of BNE, the minimum value is selected as the BNE for this frame.

Therefore, in case of an audio signal, the BNE tends to increases as time passes, for example, by 1.03 times or by 1.00547 times from frame to frame, and decreases only when the BNE becomes larger than the smoothed band energy. Accordingly, if the smoothed band energy is maintained within a relatively small range, the BNE increases as time passes, and thereby the value of the rate decision threshold (RDT) increases (see Eq. (1a) and (1b)). As a result, it becomes more likely that a frame is encoded with a rate of ⅛. In other words, if music is played for a long time, pauses tend to occur more frequently.

Figure 2A:
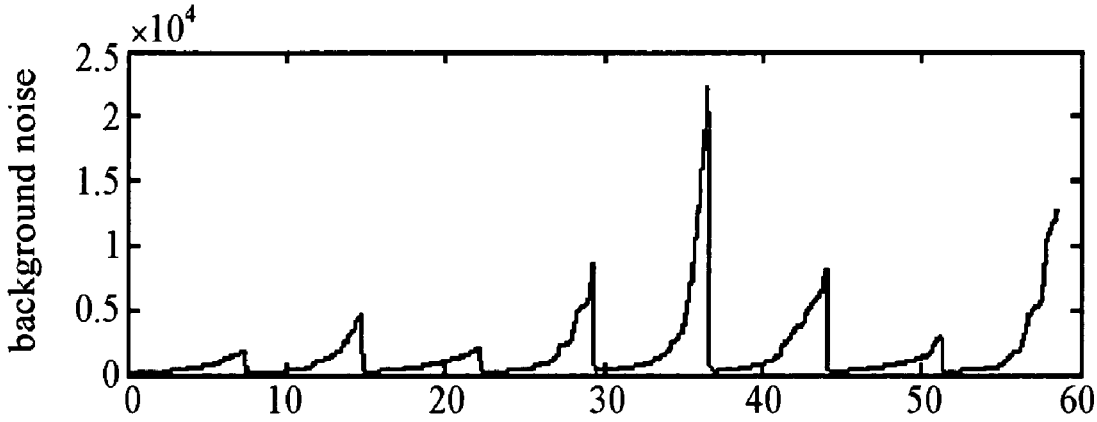
FIG. 2A is a graph showing changes in BNE (Background Noise Estimate) when voice signals are encoded by an EVRC encoder.
Figure 2B:
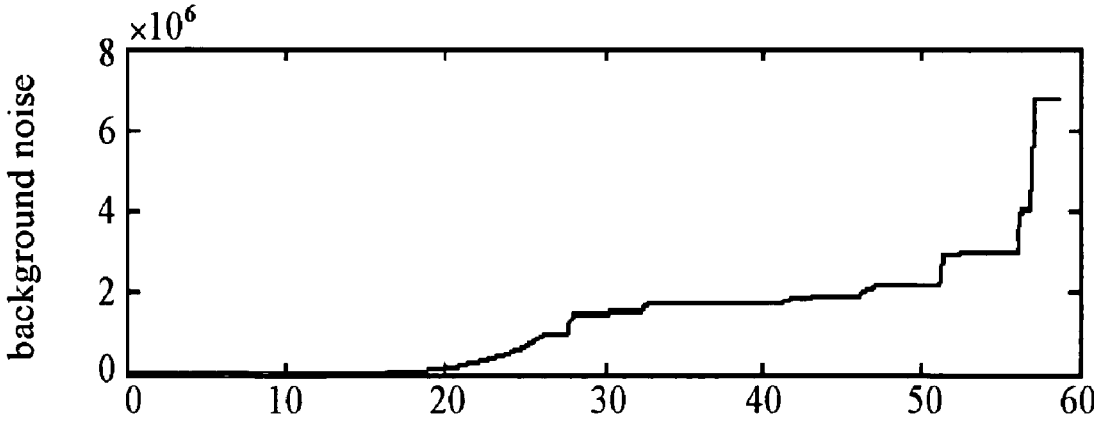
FIG. 2B is a graph showing changes in BNE when music signals are encoded by an EVRC encoder.

FIG. 2A is a graph showing changes in BNE as time passes for an EVRC encoded voice signal of 1 minute length, and FIG. 2B is a graph showing changes in BNE as time passes for an EVRC encoded music signal of 1 minute length. In FIG. 2A, there can be seen several intervals in which BNE decreases, whereas BNE is continuously increasing in FIG. 2B.

Figure 3A:
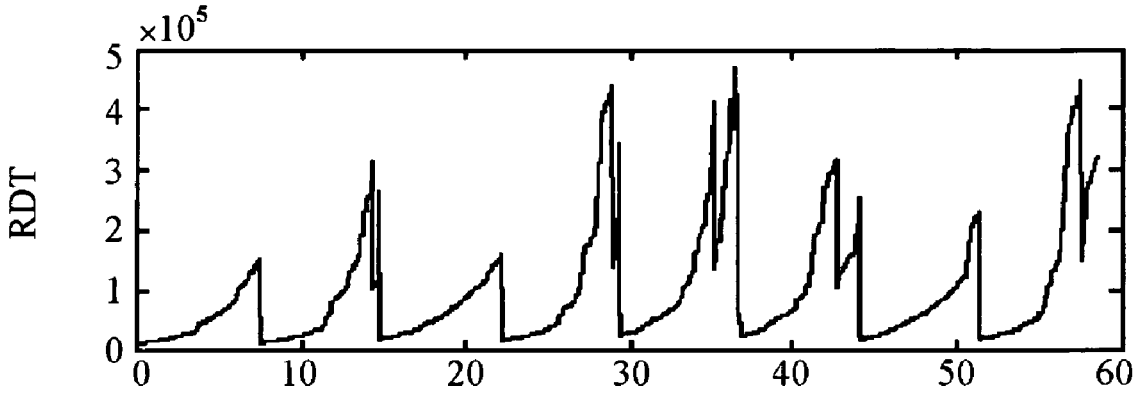
FIG. 3A is a graph showing changes in RDT (Rate Determination Threshold) in case voice signal is EVRC encoded.
Figure 3B:
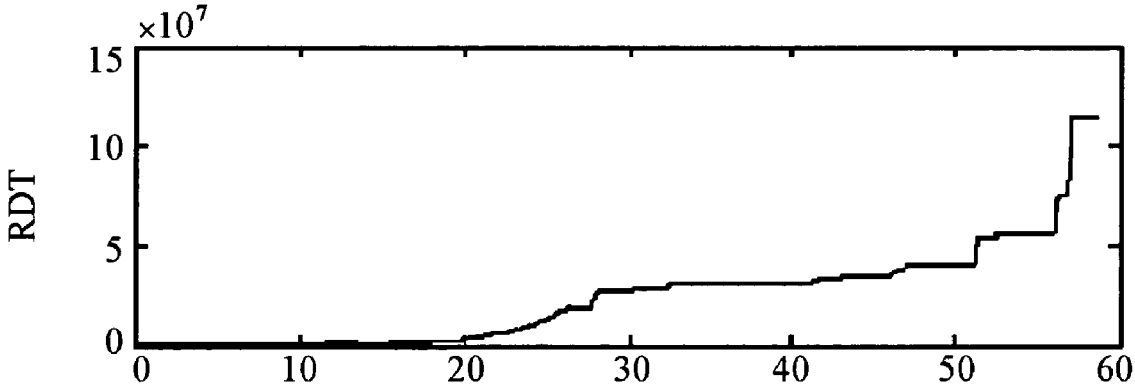
FIG. 3B is a graph showing changes in RDT in case music signal is EVRC encoded.

FIG. 3A is a graph showing changes in RDT as time passes for an EVRC encoded voice signal, and FIG. 3B is a graph showing changes in RDT as time passes. For an EVRC encoded music signal. It is recognized that FIGS. 3A and 3B show similar curve shapes as those of FIGS. 2A and 2B.

The long-term prediction gain (β) is defined by autocorrelation of residuals as follows:

$$\beta = \max\left\{o, \min\left\{1, \frac{R_{\max}}{R_\varepsilon(0)}\right\}\right\} \qquad \text{Eq. (3)}$$

Wherein ε is a prediction residual signal (which will be explained in more detail later), $R_{max}$ is a maximum value of the autocorrelation coefficients of the prediction residual signal, and $R_\epsilon(0)$ is a $0_{th}$ coefficient of an autocorrelation function of the prediction residual signal.

According to the above equation, in case of a monophonic signal or a voice signal where a dominant pitch exists, the value of β would be larger, but in case of music including several pitches, the value of β would be smaller.

The prediction residual signal (ε) is defined as follows:

$$\varepsilon[n] = s'[n] - \sum_{i=1}^{10} a_i[k]\,s'[n-i] \qquad \text{Eq. (4)}$$

wherein s'[n] is an audio signal preprocessed by the noise suppression block 110, and $a_i[k]$ is an LPC coefficient of the $k_{th}$ segment of a current frame. That is, the prediction residual signal is a difference between a signal reconstructed by the LPC coefficients and an original signal.

Now, how to decide the encoding rate will be explained. For each of the two frequency bands, if the band energy is higher than the two threshold values, the encoding rate is 1, if the band energy is between the two threshold values, the encoding rate is ½, and if the band energy is lower than both of the two threshold values, the encoding rate is ⅛. After encoding rates are decided for two frequency bands, the higher of two encoding rates decided for the frequency bands is selected as an encoding rate for that frame.

In general, polyphonic signals have less periodic components than speech signals because a polyphonic music signal consists of different instrument sounds. Accordingly, the long-term prediction gains of music signals are lower than those of speech signals. This makes BNE and RDT increase with time. Large BNE and RDT cause a normal music frame to be encoded at rate ⅛, which leads to time-clipping artifacts.

Figure 4:
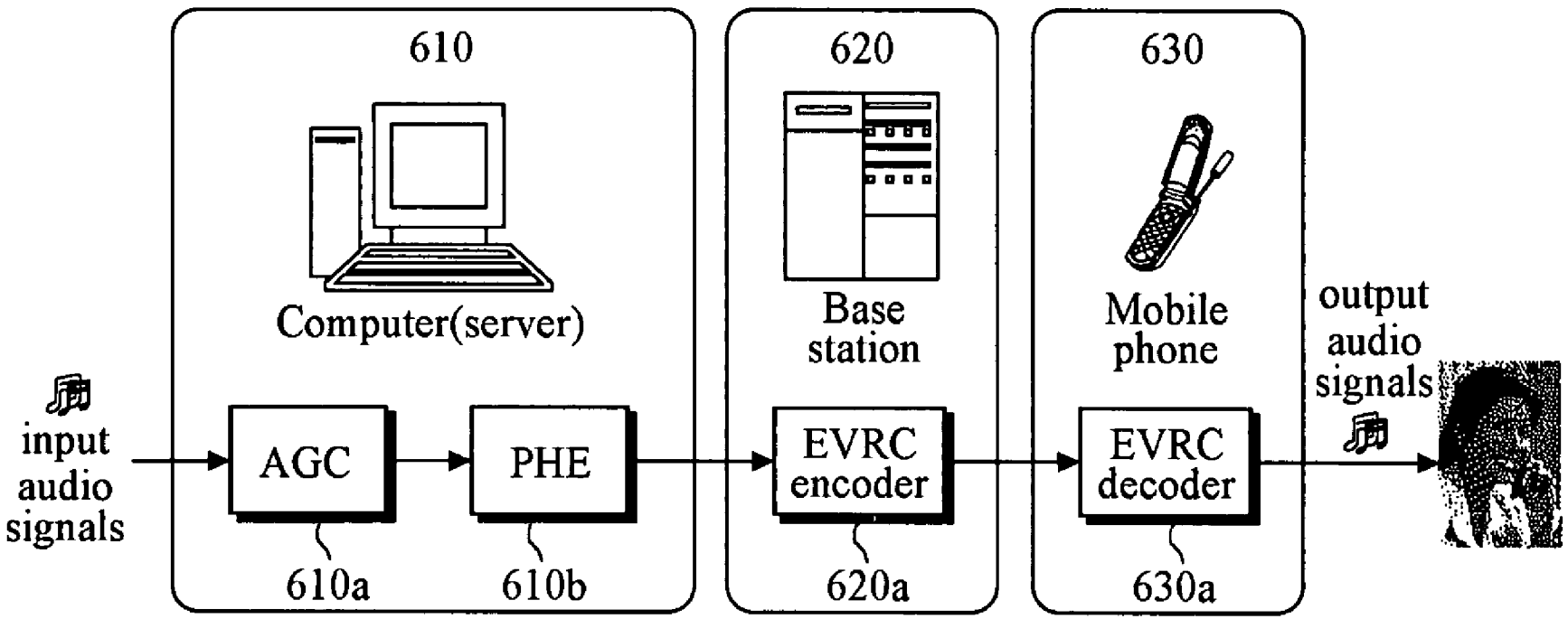
FIG. 4 is a schematic drawing for illustrating the preprocessing process according to the present invention.

As way to prevent such artifacts, the signals to be transmitted via wireless channel is pre-processed before it is subjected to encoding for wireless transmission (e.g., EVRC). FIG. 4 is a schematic diagram for preprocessing, encoding and decoding signals according to the present invention. In a computer (server) 610, preprocessing modules in accordance with the present invention are implemented. The function of the preprocessing modules 610 is to make the encoding rate of music signals 1 instead of ⅛. In a base station 620, the preprocessed input signal is encoded by an EVRC encoder 620*a*, and then transmitted to a user terminal 630. At the user' end, the transmitted signal is decoded by a decoder 630*a* in e.g., a mobile phone 630, to make a sound audible to the user.

In one embodiment of the present invention, either or both of Dynamic Range Compression ("DRC") and Pitch Harmonics Enhancement ("PHE") preprocessing may be used as the preprocessing method before the EVRC encoding. In the embodiment where two preprocessing methods are used together, the preprocessing module may include two software-implemented functional modules, an AGC module 610*a* and a PHE module 610*b* where AGC module compresses the dynamic range of the input audio signal, and the PHE module tries to increase the long-term prediction gain β.

First, DRC will be explained in detail. If a dynamic range of an input audio signal to be transmitted via a wireless communication system is much broader than that of the wireless communication system, components of the input signal having small amplitudes become lost or components of the input signal having large amplitudes become saturated. By compressing the dynamic range of an audio signal, it can be optimized to the characteristic of a speaker in mobile phones. Unlike voice signals the frames having low band energy in music signals are not necessarily noise frames. Since the dynamic range supported by a mobile communication system is narrow and the RDA of EVRC tends to regard the frames having low band energy as noise frames, music signal having broad dynamic range, when played through a mobile communication system, is more susceptible to the clipping or pause problem. Therefore, audio signals having broad dynamic range (such as audio signals having CD sound quality) need to be DRC preprocessed. In the present invention, AGC (Automatic Gain Compression) preprocessing is used as away to compress the dynamic range of audio signals.

AGC is a method for adjusting current signal gain by predicting signals for a certain interval. Conventionally, AGC is necessary in cases where music is played in speakers having different dynamic ranges. In such case, without AGC, some speakers will operate in the saturation region, and AGC should be done depending on the characteristic of the sound-generating device, such as a speaker, an earphone, or a cellular phone.

In case of a cellular phone, while it will be ideal to measure the dynamic range of the cellular phone and perform AGC in order to ensure best perceptual sound quality, it is impossible to design AGC optimized for all cellular phones because the characteristic of a cellular phone would vary depending on the manufacturer and also on a particular model. Accordingly, it is necessary to design an AGC generally applicable to all cellular phones.

Figure 5:
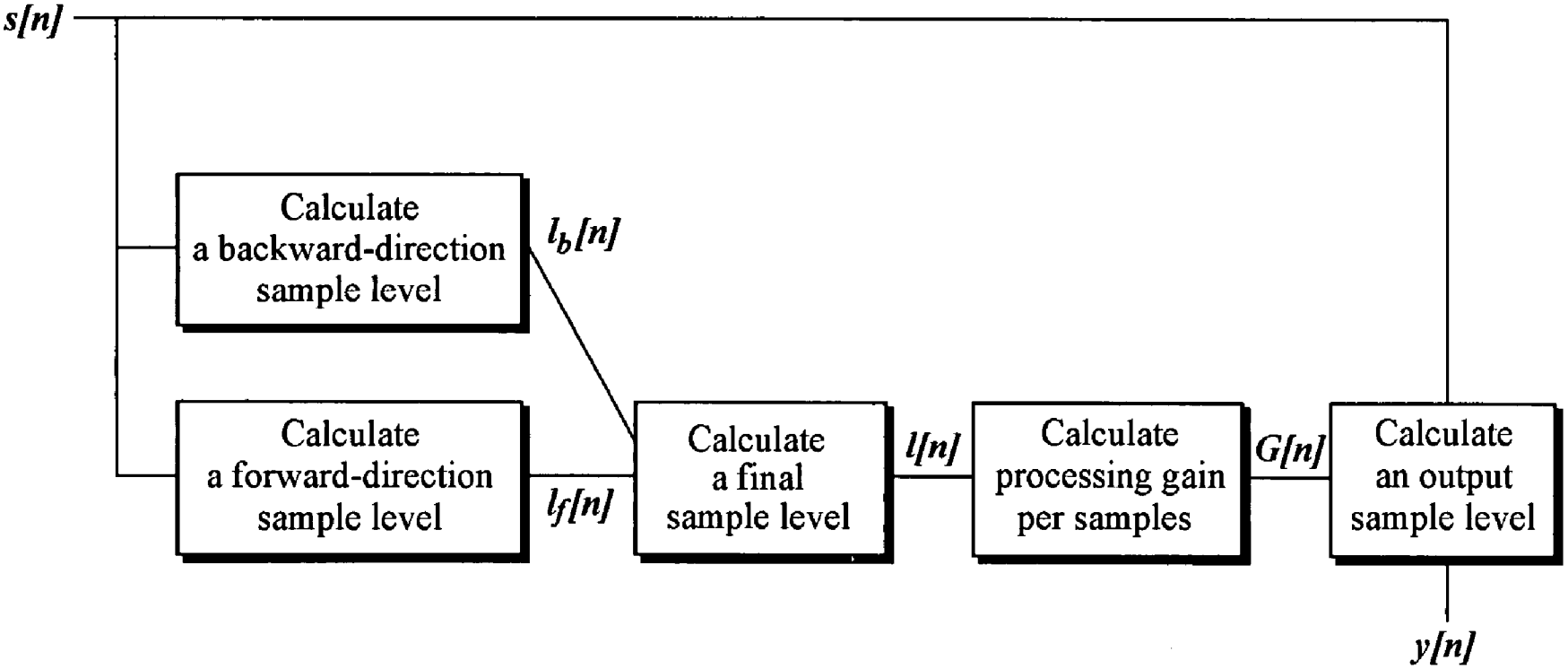
FIG. 5 is a drawing conceptually illustrating a process for AGC (Automatic Gain Control) according to the present invention.

FIG. 5 is a block diagram for illustrating the AGC processing in accordance with one embodiment of the present invention. In this embodiment, AGC is a process for adjusting the signal level of the current sample based on a control gain decided by using a set of sample values in a look-ahead window. At first, a "forward-direction signal level" $l_f[n]$ and a "backward-direction signal level" $l_b[n]$ are calculated using the "sampled input audio signal" s[n] as explained later, and from them, a "final signal level" l[n] is calculated. After l[n] is calculated, a processing gain per sample (G[n]) is calculated using l[n], and then an "output signal level" y[n] is obtained by multiplying the gain G[n] and s[n].

In the following, the functions of the blocks in FIG. 5 will be described in more detail.

Figure 6:
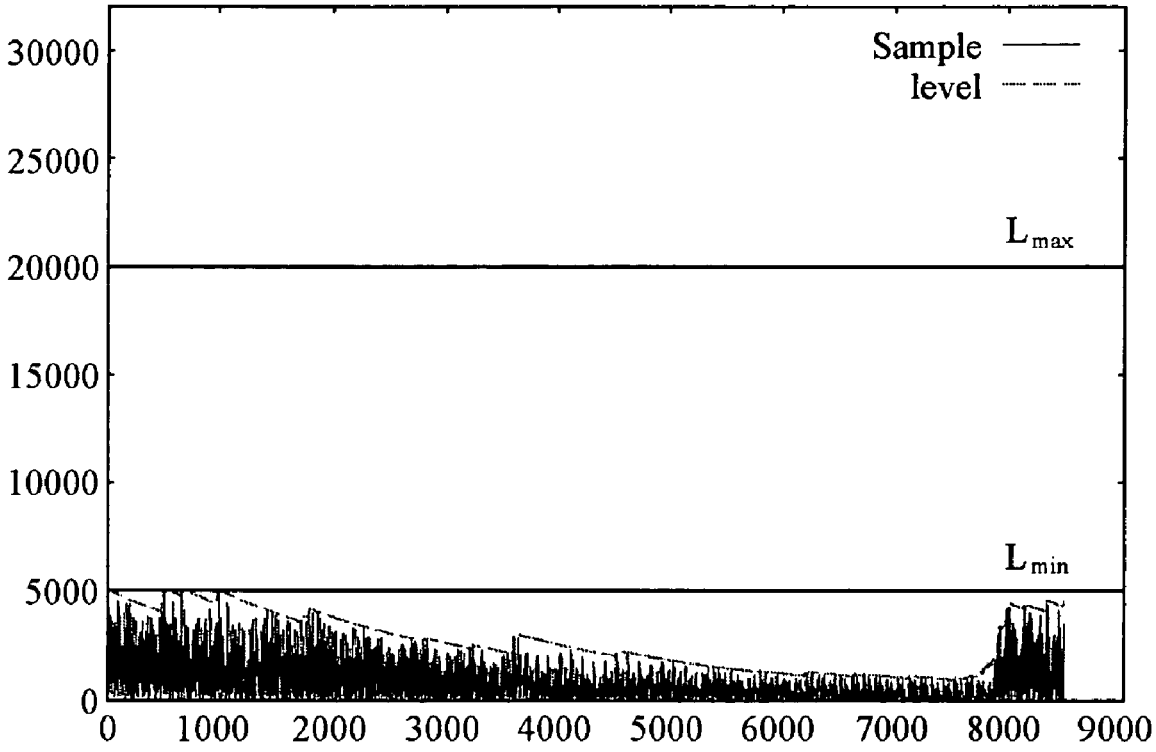
FIG. 6 shows an exemplary signal level (l[n]) calculated from the sampled audio signal (s[n])

FIG. 6 shows an exemplary signal level (l[n]) calculated from the sampled audio signal (s[n]). Exponential suppressions in the forward and backward directions (referred to "ATTACK" and "RELEASE", respectively), are used to calculate l[n]. The envelope of the signal level l[n] varies depending on how to process signals by using the forward-direction exponential suppression ("ATTACK") and backward direction exponential suppression ("RELEASE"). In FIG. 6, $L_{max}$ and $L_{min}$ are the maximum and minimum possible values of the output signal after the AGC preprocessing.

A signal level at time n is obtained by calculating forward-direction signal levels (for performing RELEASE) and backward-direction signal levels (for performing ATTACK). Time constant of an "exponential function" characterizing the exponential suppression will be referred to as "RELEASE time" in the forward-direction and as "ATTACK time" in the backward-direction. ATTACK time is a time taken for a new output signal to reach a proper output amplitude. For example, if an amplitude of an input signal decreases by 30 dB abruptly, ATTACK time is a time for an output signal to decrease accordingly (by 30 dB). RELEASE time is a time to reach a proper amplitude level at the end of an existing output level. That is, ATTACK time is a period for a start of a pulse to reach a desired output amplitude whereas RELEASE time is a period for an end of a pulse to reach a desired output amplitude.

In the following, how to calculate a forward-direction signal level and a backward-direction signal level will be described with reference to FIGS. 7A and 7B.

Figure 7A:
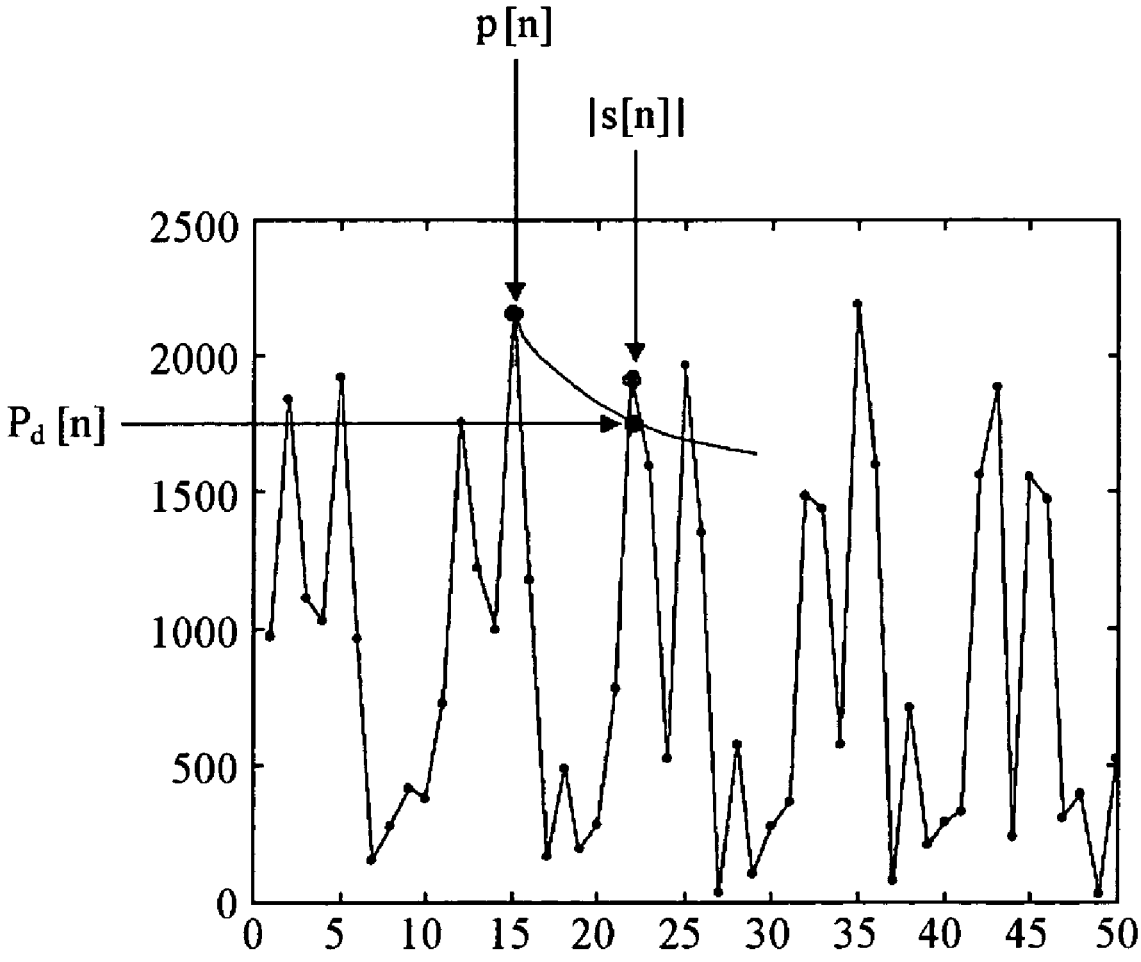
FIG. 7A is a graph for explaining the calculation of a forward-direction signal level.
Figure 7B:
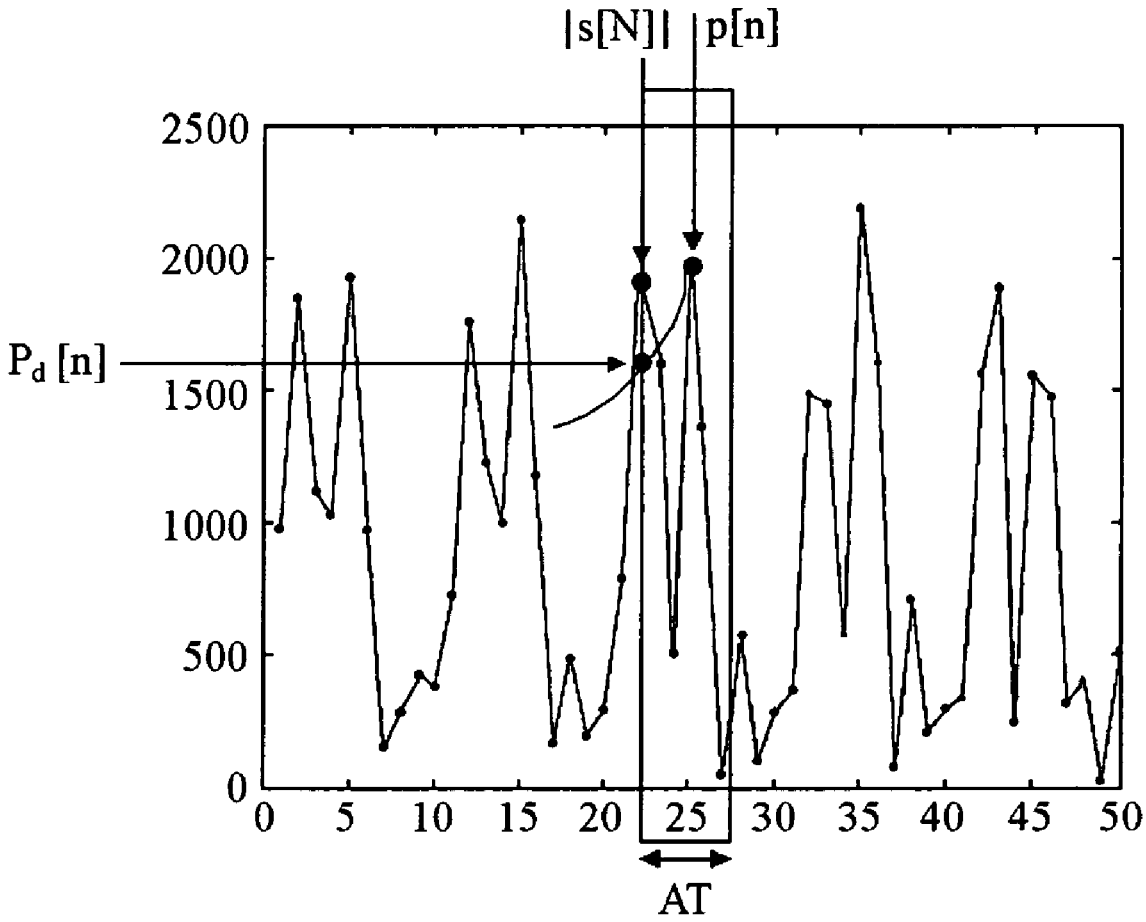
FIG. 7B is a graph for explaining the calculation of a backward-direction signal level.

With reference to FIG. 7A, a forward-direction signal level is calculated in the following steps.

In the first step, a current peak value and a current peak index are initialized (set to 0), and a forward-direction signal level ($l_f[n]$) is initialized to |s[n]|, an absolute value of s[n]. In the second step, the current peak value and the current peak index are updated. If |s[n]| is higher than the current peak value (p[n]), p[n] is updated to |s[n]|, and the current peak index ($i_p[n]$) is updated to n (as shown in the following pseudo code.)

```
if (|s[n]| > p[n]) {
   p[n] = |s[n]|
   i_p[n] = n
}
```

In the third step, a suppressed current peak value is calculated. The suppressed current peak value $p_d[n]$ is decided by exponentially reducing the value of p[n] according to the passage of time as follows:

$$p_d[n]=p[n]*\exp(-TD/RT) \quad \text{Eq. (5)}$$

$$TD=n-i_p[n]$$

Wherein RT stands for RELEASE time.

In the fourth step, a larger value out of $p_d[n]$ and |s[n]| is decided as a forward-direction signal level, as follows:

$$l_f[n]=\max(p_d[n], |s[n]|) \quad \text{Eq. (6)}$$

Next, the above second to fourth steps are repeated to obtain a forward-direction signal level ($l_f[n]$) as n increases by one at a time.

Figure 8:
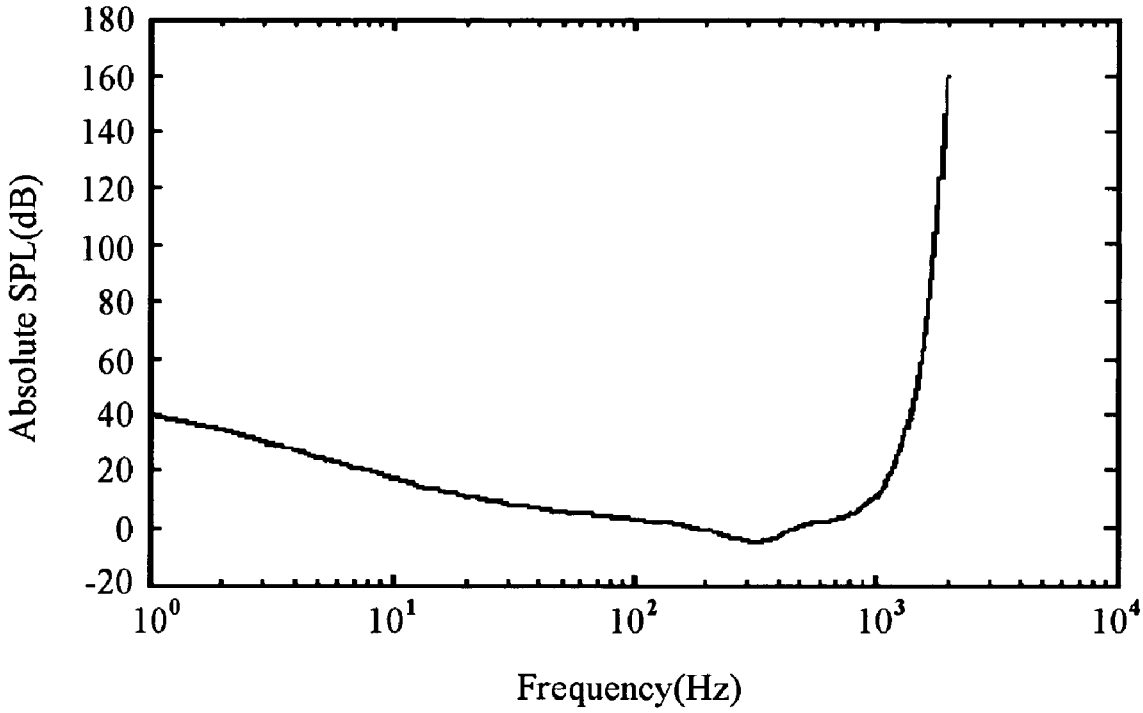
FIG. 8 is a graph showing a model of ATH (Absolute Threshold of Hearing) by Terhardt.

With reference to FIG. 8, a backward-direction signal level is calculated by the following steps.

In the first step, a current peak value is initialized into 0, a current peak index is initialized to AT, and a backward-direction signal level ($l_b[n]$) is initialized to |s[n]|, an absolute value of s[n].

In the second step, the current peak value and the current peak index are updated. A maximum value of s[n] in the time window from n to (n+AT) is detected and the current peak value p(n) is updated as the detected maximum value. Also $i_p[n]$ is updated as the time index for the maximum value.

$$p[n]=\max(\{|s[\,]|\}) \quad \text{Eq. (7)}$$

$$I_p[n]=(\text{an index of } s[\,], \text{ where } |s[\,]| \text{ has its maximum value})$$

Wherein the index of s[ ] can have values from n to (n+AT).

In the third step, a suppressed current peak value is calculated as follows.

$$p_d[n]=p[n]*\exp(-TD/AT) \quad \text{Eq. (8)}$$

$$TD=i_p[n]-n$$

Wherein AT stands for the ATTACK time.

In the fourth step, a larger value out of $p_d[n]$ and $|s[n]|$ is decided as a backward-direction signal level.

$$l_b[n]=\max(p_d[n], |s[n]|) \quad \text{Eq. (9)}$$

Next, the above second to fourth steps are repeated to obtain a backward-direction signal level ($l_b[n]$) as n increases by one at a time.

The final signal level (l[n]) is defined as a maximum value of the forward-direction signal level and the backward-direction signal level for each time index.

$$l[n]=\max(l_f[n], l_b[n]) \text{ for } t=0, \ldots, t_{max} \quad \text{Eq. (10)}$$

Wherein $t_{max}$ is a maximum time index.

The ATTACK time/RELEASE time is related to the perceptual sound quality/characteristic. Accordingly, when calculating signal levels, it is necessary to set the ATTACK time and RELEASE time properly so as to obtain sound optimized to the characteristic of a media. If the sum of the ATTACK time and RELEASE time is too small (i.e. the sum is less than 20 ms), a distortion in the form of vibration with a frequency of 1000/(ATTACK time+RELEASE time) can be heard to a cellular phone user. For example, if the ATTACK time and RELEASE time are 5 ms each, a vibrating distortion with a frequency of 100 Hz can be heard. Therefore, it is necessary to set the sum of ATTACK time and RELEASE time longer than 30 ms so as to avoid vibrating distortion.

For example, if the ATTACK is slow and the RELEASE is fast, sound with a wider dynamic range would be obtained. When the RELEASE time is long, the high frequency component of output signal is suppressed which makes the output sound dull. However, if the RELEASE time becomes very small (or RELEASE becomes "fast"—meaning of being in this regard may vary depending on the characteristic of music), the output signal processed by AGC follows the low frequency component of the input waveform, and the fundamental component of the signal is suppressed or may even be substituted by a certain harmonic distortion (the fundamental component means the most important frequency component that a person can hear, which is same as a pitch.) As ATTACK and RELEASE times become longer, pauses are better prevented but the sound become dull (loss of high frequency). Accordingly, there is a tradeoff between the perceptual sound quality and the number of pauses.

To emphasize the effect of a percussion instrument, such as a drum, the ATTACK time should be lengthened. However, in case of a person's voice, shortening ATTACK time would help preventing the starting portion's gain from decreasing unnecessarily. It is important to decide ATTACK time and RELEASE time properly to ensure the perceptual sound quality in AGC processing, and they are decided considering the properties of the signal to be processed.

Another preprocessing method for alleviating the problem of signal clipping (or pause) is PHE (Pitch Harmonics Enhancement) preprocessing based on a perceptual sound model.

The essence of PHE preprocessing is to modify a signal such that a long-term prediction gain (β) of Eq. (3) for the signal is increased. As a result, the modified signal tends to be encoded with an encoding rate of 1 in the EVRC encoding process. In this regard, a perceptual sound model is used for minimizing the distortion of perceptual sound quality. In the following, the perceptual sound model used in one embodiment of the present invention will be explained first and then, the PHE preprocessing of the present invention will be explained.

Perceptual sound models have been made based on the characteristics of human ears, that is, how human ears perceive sounds. For example, a person does not perceive an audio signal in its entirety, but can perceive a part of audio signals due to a masking effect. Such models are commonly used in the compression and transmission of audio signals. The present invention employs perceptual sound models including, among others, ATH (Absolute Threshold of Hearing), critical bands, simultaneous masking and the spread of masking, which are the ones used in MP3 (MPEC I Audio layer 3).

The ATH is a minimum energy value that is needed for a person to perceive sound of a pure tone (sound with one frequency component) in a noise-free environment. The ATH became known from an experiment by Fletcher, and was quantified in the form of a non-linear equation by Terhardt as follows:

$$T_q(f)=3.64(f/1000)^{-0.8}-6.5e^{-0.6(f/1000-3.3)^2}+10^{-3}(f/1000)^4(dB\ SPL) \quad \text{Eq. (11)}$$

Wherein SPL stands for Sound Pressure Level.

FIG. 8 is a graph showing ATH values according to the frequency.

Figure 9:
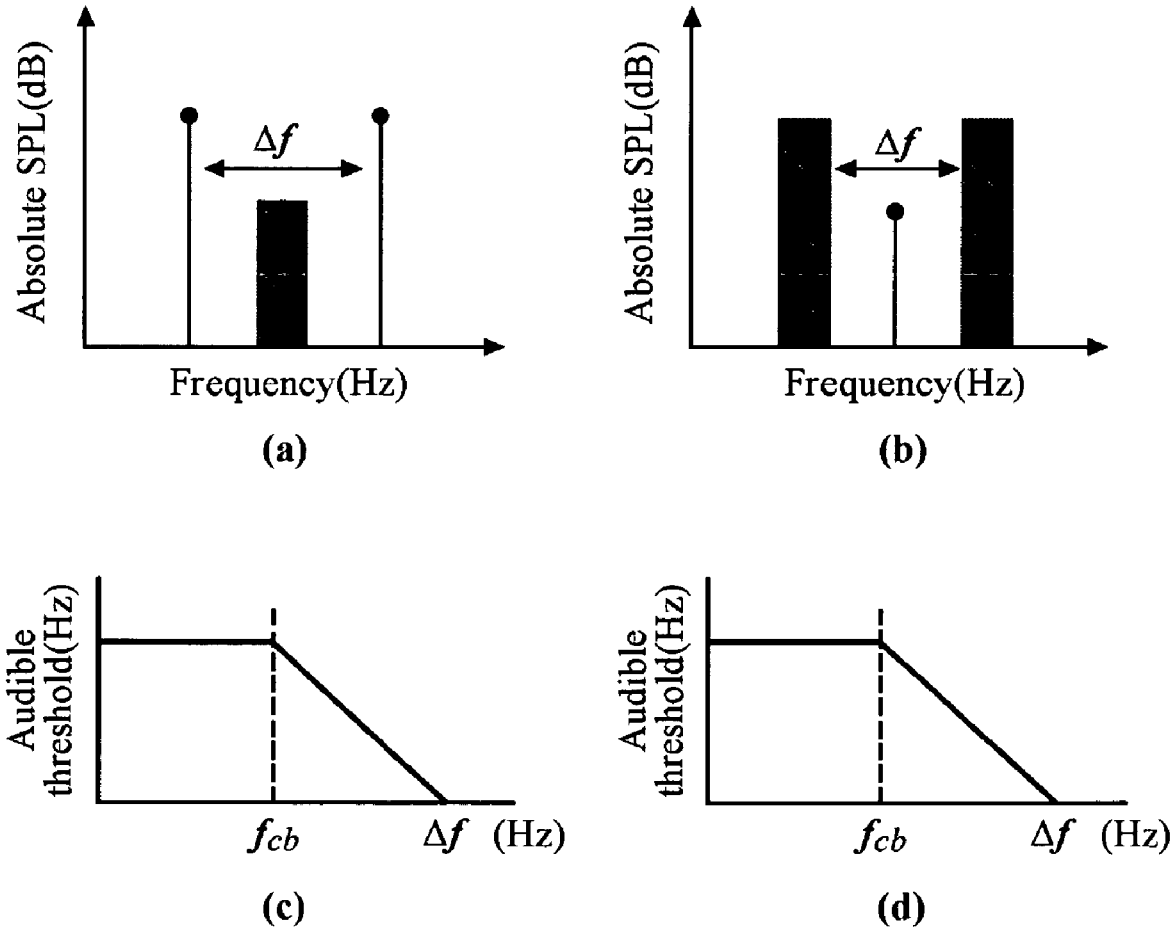
FIG. 9 is a graph showing critical bandwidth.

A critical bandwidth will be explained with reference to FIGS. 9A to 9D. In FIGS. 9A and 9B, shaded rectangle represents noise signals whereas a vertical line represents a single tone signal. A critical bandwidth represents human ear's resolving power for simultaneous tones. A critical bandwidth is a bandwidth at the boundary of which a person's perception abruptly changes as follows. If two masking tones are within a critical bandwidth (that is, the two masking tones are close to each other or Δf in FIG. 9A is smaller than the critical bandwidth $f_{cb}$), the detection threshold of a narrow band noise source between the two masking tones is maintained within a certain range. As shown in FIGS. 9B and 9D, as the frequency difference between two masking tones becomes larger than a critical bandwidth $f_{cb}$, the detection threshold for a noise starts to decrease. Accordingly, in case the frequency difference (Δf) between two masking tones is large, noise having lower amplitudes can be perceived due to the decreased detection threshold. The same phenomenon is observed in the experiment where noises in two bands are used as masking signals and a single tone is detected (see FIGS. 9B and 9D).

In consideration of the characteristics of human auditory system, the critical bandwidth for an average person is quantified as follows:

$$BW_c(f)=25+75[1+1.4(f/1000)^2]^{0.69}(Hz) \quad \text{Eq. (12)}$$

Though $BW_c(f)$ is a continuous function of the frequency f, it will be more convenient to assume that human auditory system includes a set of bandpass filters satisfying the above equation.

Bark is a more uniform measure of frequency based on critical bandwidths, and the relationship between Hz and Bark is as follows:

$$z(f)=13\arctan(0.00076f)+3.5\arctan[(f/7500)^2](Bark) \quad \text{Eq. (13)}$$

Masking is a phenomenon by which a sound source becomes inaudible to a person due to another sound source. Simultaneous masking is a property of the human auditory system where some sounds ("maskee") simply vanish in the presence of other simultaneoulsy occuring sound ("masker") having certain characteristics. Simultaneous masking includes tone-noise-masking and noise-tone-masking. The tone-noise-masking is a phenomenon that a tone in the center of a critical band masks noises within the critical band, wherein the spectrum of noise should be under the predictable threshold curve related to the strength of a masking tone. The noise-tone-masking is different from the tone-noise-masking in that the masker of the former is the maskee of the latter and the masker of the latter is the maskee of the former. That is, the presence of a strong noise within a critical band masks a tone. A strong noise masker or a strong tone masker stimulates a basilar membrane (an organ in a human ear through which frequency-location conversion occurs) in an intensity sufficient to prevent a weak signal from being perceived.

Inter-band-masking is also found. In other words, a masker within a critical band affects the detection threshold within another neighboring band. This phenomenon is called "spread of masking".

In the following, PHE preprocessing according to the present invention will be described.

Figure 10:
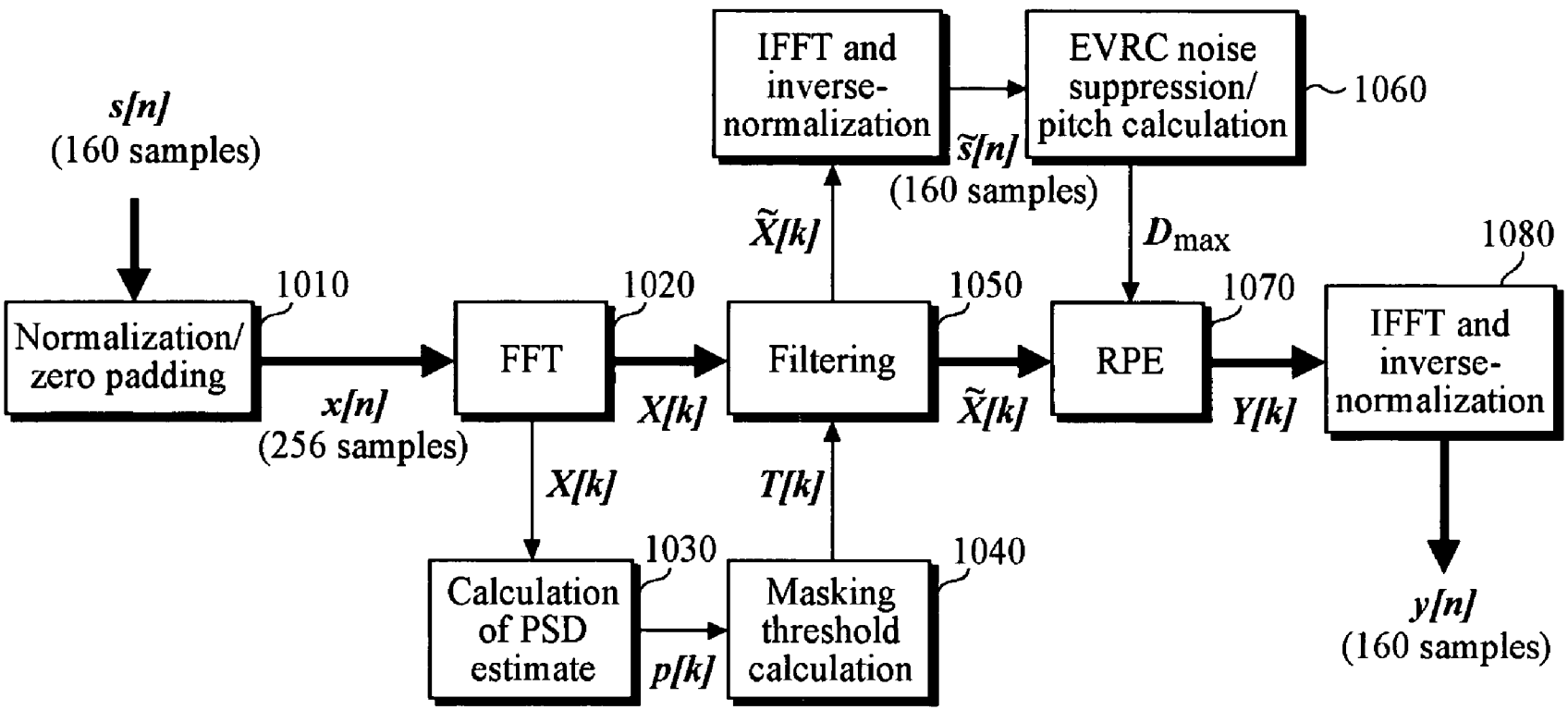
FIG. 10 is a block diagram for enhancing a pitch according to the present invention.

FIG. 10 is a block diagram showing a process for enhancing a pitch of an audio signal in accordance with the present invention. The input audio signal is transformed to the frequency domain signal in blocks 1010 and 1020. Then, a portion of the signal below the GMT (Global Masking Threshold) curve is suppressed through, e.g., multi-tone notch filtering ("MTNF") in filtering block 1050 by using a GMT curve calculated in estimated power spectrum density calculation block 1030 and masking threshold calculation block 1040. Then a residual peak value is enhanced in adaptive residual peak amplifier block 1070 by using Dmax calculated in EVRC noise suppression and pitch calculation block 1060. In the embodiment shown in FIG. 10, spectrum smoothing is done (through, e.g., multi-tone notch filtering in block 1050) and subsequently residual peak is enhanced (block 1070). However, it is possible to use either of these two methods to enhance a pitch of an audio signal. Whether to apply the spectral smoothing together with RPE (residual peak enhancement) may be decided depending on the characteristic of the sound signal, and may affect the performance of RPE preprocessing. For example, in case of heavy metal music or other sound not having a clear dominant pitch, the spectral smoothing tends to suppress the frequency components irregularly, and under such condition, residual peak enhancement does not provide the desired effect of increasing β, a long-term prediction gain. Therefore, for sound signal having such properties, it will be better not to apply the spectral smoothing before the RPE preprocessing but to apply only the RPE preprocessing.

Through the above explained processing of input signals, β, a long-term prediction gain of the signal is increased. Thus, the music pause problem caused by the RDA (Rate Determination Algorithm) of EVRC can be mitigated while maintaining the sound quality.

The above signal processing method will be explained in more detail. As explained above, the RDT value generally increases in case β is kept small for a long time (i.e., β is less than 0.3 for β consecutive frames) wherein β is a ratio of a maximum residual autocorrelation value to a residual energy value [See Eq. (3)], and β is larger when there exists a dominant pitch in a frame, but β is smaller when there is no dominant pitch. In case the smoothed band energy becomes lower than the RDT, the RDT value decreases to conform to the smoothed band energy.

This mechanism of RDT increase and decrease is suitable when human voice is encoded and transmitted through a mobile communication system for the following reason. β becomes larger for a voiced sound having a dominant pitch, and thus the voice sound (the frames having voice signals) tends to be encoded with a high encoding rate, while the frames within a silent interval only include background noise (i.e., the band energy is low) and thus the RDT decreases. Therefore, in case of human voice transmission, the RDT adjustment of the conventional encoder is suitable in maintaining the RDT values within a proper range according to the background noise.

However, since there is no silent interval in music sound, the RDT tends to increase gradually. If the music signal is monophonic and has a dominant pitch and the band energy changes over time in an irregular manner, β is large and thus, the RDT will rarely increase. However, the actual music sound would not have such characteristic, and instead, it tends to be polyphonic and has various harmonics.

Accordingly, the present invention provides a method for increasing β, a long-term prediction gain, while minimizing degradation to the sound quality. To increase β, it is necessary to increase the maximum value of the residual autocorrelation ($R_{max}$) and decrease residual energy ($R_\epsilon[0]$). To achieve this, in one embodiment of the present invention, "multi-tone notch filtering" ("MTNF") is performed in filtering block 1050 and "residual peak enhancing" is done in block 1070 for each of the audio frame signal. These two steps are preferably performed in a frequency domain.

MTNF Filtering

First, processing of signal using MTNF, will be described in the following. To maintain a low RDT (Rate Decision Threshold) value, β needs to be increased, and for this, it is necessary to increase $R_{max}$ or decrease $R_\epsilon[0]$, among which MTNF performs the latter. In order to minimize the distortion of perceptual sound quality in the preprocessing using MTNF, GMT (Global Masking Threshold) of the perceptual sound model is obtained, and then, the components under the GMT curve is selectively suppressed.

The method for calculating GMT in the present invention is adapted for the bandwidth used in the telephone communication, i.e., 8 kHz. How to calculate GMT will be described in more detail.

(1) Frequency Analysis and SPL Normalization

After dividing an input signal (8 kHz, 16 bit PCM) into 160 samples (the size of an EVRC frame), 96 0s are added to the 160 samples (which is called zero padding) to make 256 samples for FFT (Fast Fourier Transform). Also, the input audio signal sample s[n] of each of the frames is normalized based on N (the length of FFT) and b (the number of bits per sample) according to the following equation.

$$x[n] = \frac{s[n]}{N \times 2^{b-1}} \quad \text{Eq. (14)}$$

The above normalization and zero padding processes are performed in block 1010 in FIG. 10.

Then, FFT is done on the normalized input signal x[n]. From the transformed signal, a PSD (Power Spectral Density) estimate, P[k] is obtained according to the following equation (in block 1030).

$$P|k| = 90 + 20 \log_{10} X|k| (dB\ SPL) \quad \text{Eq. (15)}$$

Wherein X[k] is DFT (Discrete Fourier Transform) of x[n].

(2) Calculation of GMT (Global Masking Threshold)

In the present invention, calculation of GMT in block 1040 in FIG. 10 is done through the process explained below.

(2.1) Identification of Tone and Noise Maskers

A tonal set ($S_T$) includes frequency components satisfying the following equation.

$$S_T = \{P[k] | P[k] > P[k \pm 1], P[k] > P[k \pm 5] \pm 7 \text{ dB}\} \quad \text{Eq. (16)}$$

That is, a frequency component that has a power level higher than the background noise is added to the tonal set.

From the spectral peaks of the tonal set $S_T$, a tone masker ($P_{TM}[k]$) is calculated according to the following equation.

$$P_{TM}[k] = 10 \log_{10} \sum_{j=-1}^{1} 10^{0.1P(k+j)} \text{ (dB)} \quad \text{Eq. (17)}$$

For each of the critical bands that are not within the ±5 range from the tone masker, a noise masker ($P_{NM}[\bar{k}]$) is defined as follows.

$$P_{NM}[\bar{k}] = 10 \log_{10} \sum_{j} 10^{0.1P(j)} \text{ (dB)} \quad \text{Eq. (18)}$$

$$\forall P[j] \notin \{P_{TM}[k, k \pm 1, k \pm \Delta_k]\}$$

Wherein $\bar{k}$ is a geometric mean of the spectral line within the critical band and is calculated as follows.

$$\bar{k} = \left( \prod_{j=l}^{u} j \right)^{1/(l-u+1)} \quad \text{Eq. (19)}$$

Wherein 1 is a lower spectral boundary value and u is an upper one.

(2.2.) Reconstruction of Maskers

It is necessary to decrease the number of maskers according to the following two methods. First, tone or noise maskers, which is not larger than the maximum audible threshold, are excluded. Next, a 0.5 bark window is moved across and if more than two maskers are located within the 0.5 bark window, all maskers except the largest masker is excluded.

(2.3) Calculation of Individual Masking Thresholds

An individual masking threshold is a masking threshold at an $i_{th}$ frequency bin by a masker (either tone or noise) at a $j_{th}$ frequency bin. A tonal masker threshold is defined in the following equation.

$$T_{TM}[i,j] = P_{TM}[j] - 0.275z[j] + SF[i,j] - 6.025 (\text{dB } SPL) \quad \text{Eq. (20)}$$

Wherein z[j] is the bark of the jth frequency bin, and SF[i,j] is a spreading function, which is obtained by approximately modeling a basilar spreading function.

A noise masker threshold is defined by the following equation.

$$T_{TM}[i,j] = P_{NM}[j] - 0.175z[j] + SF[i,j] - 2.025 (\text{dB } SPL) \quad \text{Eq. (21)}$$

(2.4) Calculation of GMT

GMT is calculated as follows.

$$T_{GM}[i] = 10 \log_{10} \left( 10^{0.1\Gamma_u[i]} + \sum_{l=1}^{L} 10^{0.1\Gamma_{\pi\omega}[i,l]} + \sum_{m=1}^{m} 10^{0.1\Gamma_{\pi\omega}[i,m]} \right) \text{ (dB } SPL) \quad \text{Eq. (22)}$$

Wherein L is the number of tone maskers, and M is the number of noise maskers.

(3) Filtering by Using GMT

By suppressing the frequency components which are below the GMT curve obtained by using psycho-acoustic model as above, it is possible to reduce $R_\epsilon[0]$ without degrading the sound quality. As an extreme method of suppression, it is possible to make the frequency components lying under the GMT curve 0, but this may cause time-domain aliasing (e.g., discontinuous sound or ringing effects). To mitigate such time-domain aliasing, a suppression method using a cosine smoothing function may be employed. A frequency domain filter used in such a suppression method is referred to as MTNF (Multiple Tone Notch Filter) herein. Preprocessing of music signals using MTNF (performed in block 1050 in FIG. 10) is described in the following.

After the frequency components lower than the GMT curve are obtained, a set of continuous frequencies having a value smaller than a corresponding value in the GMT curve is represented as follows.

$$MB_i = (l_i, u_i)$$

Wherein $MB_i$ refers to the $i_{th}$ frequency band whose frequency components (value in the frequency domain) is below the GMT curve, and $l_i$ is the starting point in the $i_h$ frequency band, and $u_i$ is the end point in the frequency band.

An MTNF function applicable to MBi is as follows:

$$F[k] = \begin{cases} \frac{1-\alpha}{2} \cos \frac{2\pi(k - l_i)}{u_i - l_i} + \frac{1+\alpha}{2}, & \text{for } k \in MB_i \\ 1, & \text{for } k \notin MB_i \end{cases} \quad \text{Eq. (23)}$$

Wherein k is the frequency number, and a is a suppression constant having value between 0 and 1, and a lower α means that a stronger suppression is applied. The value of α can be decided through experiments using various types of sound, and in one preferred embodiment, 0.001 is selected for α through experiments using music sound.

By multiplying X[k], which is a DFT (Discrete Fourier Transform) coefficient of a normalized input signal (x[n]) by the above MTNF function, $\overline{X}[k]$ is obtained.

$$\tilde{X}[k]=X[k]\times F[k] \text{ for } 0\leqq k<256 \quad \text{Eq. (24)}$$

By performing the above process of obtaining the MTNF function (or the smoothing function) and of filtering using it, the frequency components over the GMT curve are enhanced and the frequency components smaller than GMT value (frequency component below the GMT curve) are suppressed. As a result, the residual energy ($R_\epsilon[0]$) is decreased.

Figure 11:
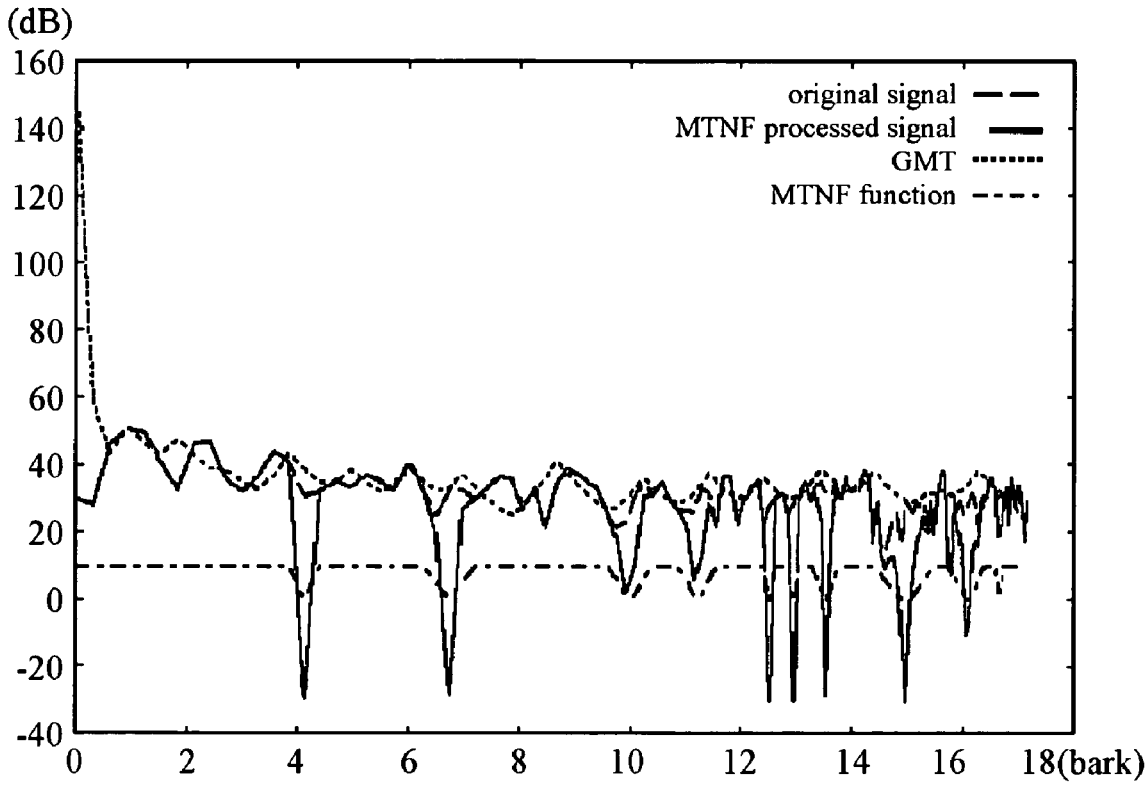
FIG. 11 is a graph showing changes of spectrum in case an MTNF (Multi-Tone Notch Filtering) is applied.

FIG. 11 is a graph showing changes of spectrum in case an MTNF function is applied to an input signal. In the spectrum filtered by MTNF, it is observed that the dominant pitch is enhanced and the frequency components that are smaller than the GMT value (portions under the GMT curve) are suppressed when compared with the original spectrum.

Residual Peak Enhancing ("RPE")

Next, RPE preprocessing will be explained, which is performed in blocks 1060 and 1070 in the embodiment shown in FIG. 10. A pitch interval (D) is estimated by inputting the frame signals (in the embodiment shown in FIG. 10, frame signal processed by MTNF) to an EVRC encoder, wherein D means a difference (or an interval) between two adjacent peaks (samples having peak values) of residual autocorrelation in the time domain. The autocorrelation and the power spectral density is a Fourier transform pair. Accordingly, if the interval between two adjacent peaks is D for the residual autocorrelation in the time domain, the spectrum of residuals will have peaks with an interval of N/D in the frequency domain. Therefore, if signal samples at an interval of N/D are enhanced (that is, every N/Dth signal sample is enhanced) in the frequency domain, signal samples at an interval of D are enhanced in the time domain (every Dth residual component is increased), which in turn increases β, the long-term prediction gain.

When enhancing the signal sample at an N/D interval, the following two factors may affect the performance (the resulting sound quality); (i) how to decide the first position (first sample) to apply enhancement at an interval of N/D; and (ii) how to specifically process each frequency component for the enhancement.

The first position determines which set of the frequency components is enhanced, and which set is left unchanged. In one embodiment of the present invention, the first frequency is decided such that a maximum value component is included in the set to be enhanced. In another embodiment of the present invention, the first position is decided such that a square sum of the components in the set to be enhanced (a set including N/Dth, 2N/Dth, 3N/Dth . . . components from the first component) becomes the largest. The first method works well with a signal having more distinctive peaks, and the second method works better in case of signals not having distinctive peaks (e.g., heavy metal sound).

As to (ii) how to enhance the signal samples, in the present invention, two different methods of enhancing the selected frequency components may be used. The first is to enhance corresponding components up to the GMT curve, and the second is to multiply a pitch harmonic enhancement ("PHE") response curve explained below to each frequency component.

The first method of enhancing the frequency components can be represented as follows:

$$Y[k]=\begin{cases} T_{GM}[k], & \text{for } k=\lfloor l\times N/D\rfloor \text{ and } \tilde{X}[k]<T_{GM}[k] \\ \tilde{X}[k], & \text{otherwise} \end{cases} \quad \text{Eq. (25)}$$

When using this method, there is little change (degradation) in the sound quality of the music, but also, β is not increased much. Accordingly, the problem of sound pause can be mitigated by using this method for only limited types of music signals.

The second method of enhancement is to multiply each frequency component by the PHE response (H[k]), as follows.

$$Y[k]=\tilde{X}[k]\times H[k]+^{1} \quad \text{Eq. (26)}$$

$$H[k]=\begin{cases} 1, & 0\leq k<\lfloor N/p\rfloor \\ \eta\cos\left(\frac{2\pi k}{N/p}\right)+(1-\eta), & \lfloor N/p\rfloor\leq k<N \end{cases}$$

In the above equation, η is the suppressing coefficient between 0 and 1, p is a pitch determined per frame, k is the frequency number (an integer value from 0 to 255) of the DFT, Y[k] is an output frequency response, and $\overline{X}[k]$ is the frequency response of a normalized frame audio signal x[n] (after x[n] is processed by MTNF in one embodiment of the present invention).

In the above equation of H[k], H[k] at multiples of a dominant pitch frequency is 1, and for other frequencies, H[k] is less than 1. In other words, the pitch-harmonic components maintain the original values, while the other frequency components are suppressed. As η increases, the harmonic components become more contrasted with the others. Since the pitch-harmonic components become enhanced, the pitch components in the time domain become enhanced, and thereby the long-term prediction gain increases.

In the above two methods of enhancing signal, the signal quality and the value of PHE response have a trade-off relationship. If the signal quality should be strictly maintained, the first method of enhancing the value to the threshold curve may work better whereas, to improve the pause phenomenon at the expense of overall signal quality, the second method of applying PHE response is preferred.

Finally, how to obtain output signals ($Y_m[k]$ and $y'_m[n]$) will be explained. $Y_m[k]$ is obtained by performing PHE preprocessing to the normalized frequency domain signal ($X_m[k]$) of $m_{th}$ frame, and $y'_m[n]$ is a reverse-normalized signal obtained by performing IFFT (Inverse Fast Fourier Transform) to $Y_m[k]$.

By working the above methods of the present invention, the encoding rate of music signals is enhanced, and thereby the problem of music pause caused by EVRC can be significantly improved.

Now, test results using the method of the present invention will be explained. For the test, 8 kHz, 16 bit sampled monophonic music signals are used, and the frequency response of an anti-aliasing filter is maintained flat with less than 2 dB deviation between 200 Hz and 3400 Hz, as defined in ITU-T Recommendations, in order to ensure that the sound quality of input audio signals is similar to that of actual sound transmitted through telephone system. For selected music songs, PHE preprocessing proposed by the present invention is applied.

Figure 12A:
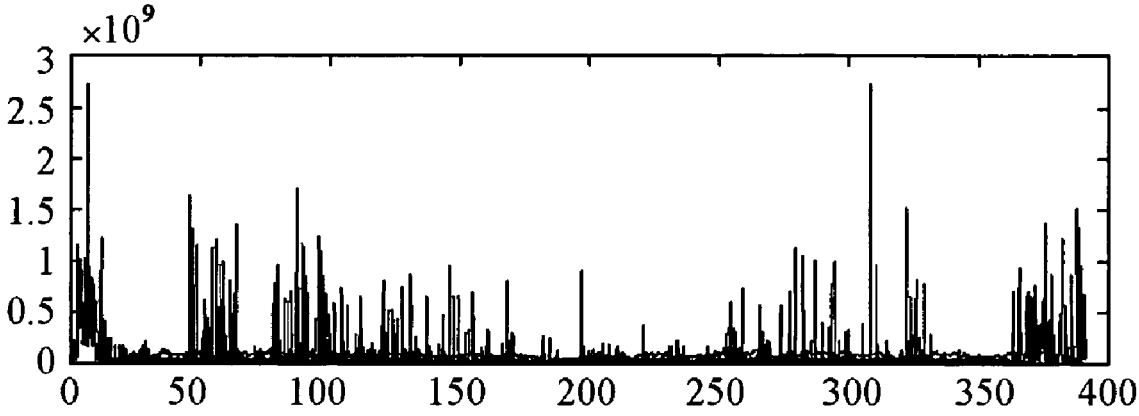
FIGS. 12A and 12B are graphs showing changes of band energy and RDT in case the preprocessing according to the present invention is performed.
Figure 12B:
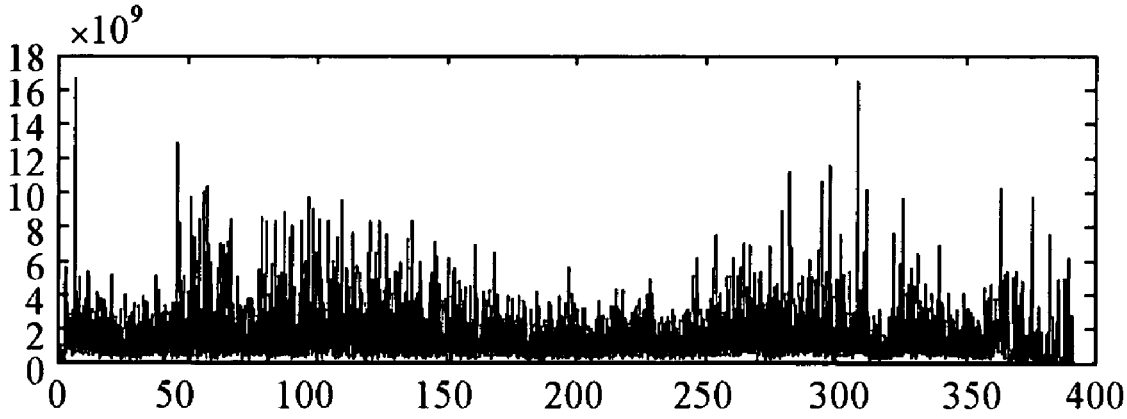

FIGS. 12A and 12B are graphs showing changes of band energy and RDT in case the preprocessing in accordance with the present invention is performed to "Silent Jealousy" (a Japanese song by the group called "X-Japan"). In case of the original signals with no preprocessing (FIG. 12A), pauses of music occur frequently because RDT is maintained higher than the band energy after the first 15 seconds, whereas for the preprocessed audio signals (FIG. 12B), pauses has been hardly detected because RDT is maintained lower than the band energy.

TABLE 2

| | Original signal | Preprocessed signal |
|---|---|---|
| Number of frames with an encoding rate of ⅛ | 1567 | 29 |

Table 2 shows the number of frames with an encoding rate of ⅛ when each of the original signal and the preprocessed signal are EVRC encoded. As shown in Table 2, in case of a preprocessed signal, the number of the frames encoded with an encoding rate of ⅛ greatly decreases.

A mean opinion score ("MOS") test to a test group of 11 people at the age of 20s and 30s has been performed for the comparison between the original music and the preprocessed music. The MOS test is a method for measuring the perceptual quality of voice signals encoded/decoded by audio codecs, and is recommended in ITU-T Recommendations P. 800. Samsung Anycal™ cellular phones are used for the test. Non-processed and preprocessed music signals had been encoded and provided to a cell phone in random sequences, and evaluated by the test group by using a five-grade scoring scheme as follows (herein, excellent sound quality means a best sound quality available through the conventional telephone system):

(1) bad (2) poor (3) fair (4) good (5) excellent

Three songs were used for the test, and Table 3 shows the result of the experiment. According to the test result, through the preprocessing method of the present invention, average points for the songs had been increased from 3.000 to 3.273, from 1.727 to 2.455, and from 2.091 to 2.727.

TABLE 3

| Title of songs (Composer) | Genre of songs | Average points for original songs | Average points for preprocessed songs |
|---|---|---|---|
| Girl's Prayer (Badarczevska) | Piano Solo | 3.000 | 3.273 |
| Sonata Pathetic Op 13 (Beethoven) | Piano Solo | 1.727 | 2.455 |
| Fifth symphony (Fate) (Beethoven) | Symphony | 2.091 | 2.727 |

By the preprocessing methods according to the present invention, the encoding rate of music signals is enhanced, and thereby the problem of music pauses caused by EVRC can be significantly improved. Accordingly, the sound quality through a cellular phone is also improved.

In one embodiment of the invention, conventional telephone and wireless phone may be serviced by one system for providing music signal. In that case, a caller ID is detected at the system for processing music signal. In a conventional telephone system, a non-compressed voice signal with 8 kHz bandwidth is used, and thus, if 8 kHz/8 bit/a-law sampled music is transmitted, music of high quality without signal distortion can be heard. In one embodiment of the invention, a system for providing music signal to user terminals determines whether a request for music was originated by a caller from a conventional telephone or a wireless phone, using a caller ID. In the former case, the system transmits original music signal, and in the latter case, the system transmits preprocessed music.

It would be apparent to the person in the art that the preprocessing method of the present invention can be implemented by using either software or a dedicated hardware. Also, in one embodiment of the invention VoiceXLM system is used to provide music to the subscribers, where audio contents can be changed frequently. In such a system, the preprocessing of the present invention can be performed on-demand basis. To perform this, a non-standard tag, such as <audio src="xx.wav" type="music/classical/">, can be defined to determine whether to perform preprocessing or types of preprocessing to be performed.

The application of the present invention includes any wireless service that provides music or other non-human-voice sound through a wireless network (that is, using a codec for a wireless system). In addition, the present invention can also be applied to another communication system where a codec used to compress the audio data is optimized to human voice and not to music and other sound. Specific services where the present invention can be applied includes, among others, "coloring service" and "ARS (Audio Response System)."

The pre-processing method of the present invention can be applied to any audio data before it is subject to a codec of a wireless system (or any other codec optimized for human voice and not music). After the audio data is preprocessed in accordance with the pre-processing method of the present invention, the pre-processed data can be processed and transmitted in a regular wireless codec. Other than adding the component necessary to perform the pre-processing method of the present invention, no other modification to the wireless system is necessary. Therefore, the pre-processing method of the present invention can be easily adopted by an existing wireless system.

Although the present invention is explained with respect to the EVRC codec, in other embodiment of the present invention, it can be applied in a similar manner to other codecs having variable encoding rate.

The present invention is described with reference to the preferred embodiments and the drawings, but the description is not intended to limit the present invention to the form disclosed herein. It should be also understood that a person skilled in the art is capable of using a variety of modifications and another embodiments equal to the present invention. Accordingly, only the appended claims are intended to limit the present invention.

What is claimed is:

1. A method for processing an audio signal, comprising the steps of:

performing a pitch harmonic enhancement ("PHE") preprocessing of the audio signal, wherein the PHE preprocessing enhances the pitch components of the audio signal;

determining an encoding rate from a plurality of encoding rates based on a characteristic of the PHE preprocessed audio signal; and encoding the PHE preprocessed audio signal with the determined encoding rate at a codec having the plurality of encoding rates.

2. A method as defined in claim 1, wherein said step of performing PHE preprocessing is to modify the audio signal such that a long-term prediction gain of the audio signal is increased.

3. A method as defined in claim 1, wherein said step of performing PHE preprocessing comprises the step of: applying a smoothing filter in a frequency domain.

4. A method as defined in claim 3, wherein said step of applying a smoothing filter comprises the step of: applying a Multi-Tone Notch Filter ("MTNF") for decreasing residual energy.

5. A method as defined in claim 1, wherein said step of performing PHE preprocessing comprises the step of performing Residual Peak Enhancement ("RPE").

6. A method as defined in claim 1 wherein said step of performing PHE preprocessing comprises the step of: applying a smoothing filter in a frequency domain; and performing RPE, wherein said step of applying a smoothing filter is selectively performed depending on a characteristic of the audio signal.

7. A method as defined in claim 6, wherein said step of applying a smoothing filter comprises the step of: applying a Multi-Tone Notch Filter ("MTNF") for decreasing residual energy.

8. A method as defined in claim 7, wherein said step of applying MTNF comprises the steps of: evaluating a Global Masking Threshold ("GMT") curve of the audio signal in accordance with a perceptual sound model; and selectively suppressing frequency components under said GMT curve.

9. A method as defined in claim 8, wherein said step of evaluating a GMT curve comprises the steps of: normalizing absolute Sound Pressure Level ("SPL") by analyzing frequency components of the audio signal; determining tone maskers and noise maskers; reconstructing maskers by selecting a set of maskers among said determined maskers; calculating individual masking thresholds for the selected set of maskers; and calculating GMT from the calculated individual maskers.

10. A method as defined in claim 8, wherein said frequency suppressing step comprises the steps of: making the portion below the GMT curve 0.

11. A method as defined in claim 8, wherein said frequency suppressing step comprises the steps of: multiplying by a cosine smoothing function to the portion below the GMT curve.

12. A method as defined in claim 5, wherein said step of performing RPE comprises the steps of: multiplying selected frequency components by a Peak Harmonic Enhancement ("PHE") response that is a function of a pitch for each frame, thereby enhancing the components at the multiples of pitch frequency relative to other components.

13. A method as defined in claim 6, wherein said step of performing RPE comprises the steps of: multiplying selected frequency components by a Peak Harmonic Enhancement ("PHE") response that is a function of a pitch for each frame, thereby enhancing the components at the multiples of pitch frequency relative to other components.

14. A method as defined in claim 5, wherein said step of performing RPE comprises the steps of: increasing selected frequency components to corresponding GMT values, thereby enhancing the components at the multiples of pitch frequency relative to other components.

15. A method as defined in claim 6, wherein said step of performing RPE comprises the steps of: increasing selected frequency components to corresponding GMT values, thereby enhancing the components at the multiples of pitch frequency relative to other components.

16. A method as defined in claim 1, further comprising the step of performing dynamic range compression ("DRC") preprocessing by an AGC (Automatic Gain Control) preprocessing.

17. A method as defined in claim 16, wherein said AGC preprocessing comprises the steps of: calculating a forward-direction signal level; calculating a backward-direction signal level; and generating a processed signal by calculating a final signal level based on said calculated forward and backward signal levels.

18. A system for processing an audio signal, comprising:

means for performing a pitch harmonic enhancement ("PHE") preprocessing of the audio signal, wherein the PHE preprocessing enhances the pitch components of the audio signal;

means for receiving and encoding the PHE preprocessed audio signal, wherein said means for performing PHE preprocessing comprises means for applying a smoothing filter in a frequency domain selectively depending on a characteristic of the audio signal; and means for performing residual peak enhancement, wherein said means for receiving and encoding the PHE preprocessed audio signal determines an encoding rate from a plurality of encoding rates based on a characteristic of the PHE preprocessed audio signal and encodes the PHE preprocessed audio signal with the determined encoding rate.

19. A system as defined in claim 18, wherein said means for applying a smoothing filter comprises means for applying a Multi-Tone Notch Filter ("MTNF") for decreasing residual energy.

20. A system as defined in claim 19, wherein said means for applying MTNF comprises: means for evaluating a Global Masking Threshold ("GMT") curve of the audio signal in accordance with a perceptual sound model; and means for selectively suppressing frequency components under said GMT curve.

21. A system as defined in claim 20, wherein said means for evaluating a GMT curve comprises: means for normalizing absolute Sound Pressure Level ("SPL") by analyzing frequency components of the audio signal; means for determining tone maskers and noise maskers; means for reconstructing maskers by selecting a set of maskers among said determined maskers; means for calculating individual masking thresholds for the selected set of maskers; and means for calculating GMT from the calculated individual maskers.

22. A system as defined in claim 18, wherein said means for performing RPE comprises: means for multiplying selected frequency components by a Peak Harmonic Enhancement ("PHE") response that is a function of a pitch for each frame, thereby enhancing the components at the multiples of pitch frequency relative to other components.

23. A system as defined in claim 18, wherein said means for performing RPE comprises: means for increasing selected frequency components to corresponding GMT values, thereby enhancing the components at the multiples of pitch frequency relative to other components.

* * * * *